US005655255A

United States Patent [19]

Kelly

[11] Patent Number: 5,655,255

[45] Date of Patent: Aug. 12, 1997

[54] WATER EXTRACTOR AND NOZZLE THEREFOR

[75] Inventor: Luke E. Kelly, Grand Rapids, Mich.

[73] Assignee: Bissell Inc., Grand Rapids, Mich.

[21] Appl. No.: 498,601

[22] Filed: Jul. 6, 1995

[51] Int. Cl.[6] ..... A47L 9/02

[52] U.S. Cl. ..... 15/322; 15/321; 29/890.1; 239/597; 239/601

[58] Field of Search ..... 5/321, 322; 239/597, 239/599, 601; 29/890.09, 890.1

[56] References Cited

U.S. PATENT DOCUMENTS

| | | | |
|---|---|---|---|
| 1,045,475 | 11/1912 | Van Zandt . | |
| 1,569,448 | 1/1926 | Banner . | |
| 1,630,974 | 5/1927 | Shelor et al. . | |
| 2,809,073 | 10/1957 | Wahlert | 239/597 |
| 2,985,386 | 5/1961 | Steinen . | |
| 3,101,906 | 8/1963 | Webber | 239/601 |
| 3,647,147 | 3/1972 | Cook . | |
| 3,754,710 | 8/1973 | Chimura | 239/597 |
| 3,883,301 | 5/1975 | Emrick et al. . | |
| 4,236,674 | 12/1980 | Dixon . | |
| 4,334,336 | 6/1982 | Harbeck et al. | 15/322 |
| 4,346,849 | 8/1982 | Rood . | |
| 4,688,720 | 8/1987 | MacDonald et al. . | |
| 4,720,889 | 1/1988 | Grave | 15/322 |
| 4,913,225 | 4/1990 | Chubb | 239/597 |
| 5,046,668 | 9/1991 | Ikeuchi et al. | 239/597 |
| 5,199,649 | 4/1993 | Tolboll | 239/597 |
| 5,211,335 | 5/1993 | Strid . | |
| 5,288,027 | 2/1994 | Herstek et al. . | |

*Primary Examiner*—David Scherbel
*Assistant Examiner*—Terrence Till
*Attorney, Agent, or Firm*—Varnum, Riddering, Schmidt & Howlett LLP

[57] ABSTRACT

A water extractor and nozzle for spraying fluid in an even distribution across a predetermined area. The nozzle comprises a tubular body with an axial fluid channel, which intersects a nozzle opening through which the fluid is sprayed onto the surface being cleaned. The nozzle opening is defined by opposed sidewalls connected to opposed end walls. The sidewalls are concave outwardly. The sidewalls and end walls define the spray coverage area and the shape of the opening controls the distribution of the fluid across the spray coverage area.

12 Claims, 2 Drawing Sheets

WATER EXTRACTOR AND NOZZLE THEREFOR

BACKGROUND OF THE INVENTION

1. Field of the Invention

This invention relates to water extractor machines, and, more particularly, to a nozzle for attachment to a water extractor, which controls the spray pattern of the machine.

2. Description of Related Art

Consumers have long cleaned their carpets, rugs and floors with vacuum cleaner machines. These machines apply suction to the surface to be cleaned to remove dirt and dust particles, a process commonly called dry vacuuming. Vacuum cleaners usually include a suction filter or wand for overlying the carpet or other surface to be cleaned. The suction distributes the suction supplied by the vacuum cleaner over a broad area through the use of a nozzle mounted in the foot. A rotating brush or beater bar is typically mounted in the housing to aid in the removal of dirt and dust from the surface being vacuumed.

An alternative to dry vacuuming is the use of a water extractor or deep cleaning machine. These machines apply an aqueous cleaning solution to the surface of the carpet or floor to be cleaned and remove this solution by applying suction, a process commonly called deep cleaning. Water extractors are often more effective in removing dirt and dust from a carpet surface than dry vacuuming. The water extractor or deep cleaning machines typically have a suction head in combination with a spray nozzle. The spray nozzle sprays the water or cleaning fluid onto the surface to be cleaned as the suction head is drawn over the surface to remove the dirt and the fluid.

When deep cleaning, it is desirable to use the minimum mount of fluid necessary to achieve the proper cleaning of the carpet. The excess use of fluid results in longer drying times and an unnecessary increase in the mount and cost of the cleaning fluid needed to clean the carpet or surface to be cleaned. Therefore, it is important to shape the spray pattern from the nozzle to a width no wider than the associated suction nozzle and to a uniform thickness sufficient to lay down the right mount of cleaning solution.

This same concept has been applied to upholstery cleaning tools which are somewhat smaller than the rug cleaning tools. It is more important that the spray pattern be accurately controlled in these devices to avoid over-wetting the upholstery.

Heretofore, the spray nozzles for deep cleaning vacuum machines have been molded with a nozzle opening which has resembled a slit, as if made by a saw cut. The nozzle opening typically has bowed sides which terminate at points at the ends thereof. These nozzles have required testing to determine an appropriate spray pattern which is ultimately hard to control.

SUMMARY OF THE INVENTION

According to the invention, a cleaning tool for a deep cleaning vacuum machine comprises an elongated suction conduit adapted to be connected at one end to a source of suction, a suction head connected to another end of the elongated conduit and having an open end forming an elongated suction conduit with an elongated opening therein, a fluid conduit having an axial channel with a longitudinal axis mounted on the tubular conduit and adapted to be connected at one end to a source of cleaning fluid to supply cleaning fluid to the elongated channel. The fluid conduit at another end forms a nozzle tip with a nozzle opening extending therethrough to the axial conduit. The nozzle opening is generally rectangular in configuration through the nozzle tip and is defined by sidewalls and end walls. The sidewalls slope outwardly from the axial channel at an acute angle to the longitudinal axis of the axial channel and the end walls slope outwardly from the axial channel at an acute angle to the longitudinal axis of the axial channel. The acute angle of the sidewall is generally in the range of 5° to 25° and preferably in the range of 12° to 18°. A preferred angle of the side wall with the longitudinal axis is 15°. The acute angle of the end wall is generally in the range of 5° to 37°, preferably in the range of 12° to 18°. A preferred angle of the end wall with the longitudinal axis is 15°. The particular angles defined by the end walls and sidewalls depend on the distance from the elongated suction nozzle opening and the nozzle opening and on the width of the nozzle opening. Preferably, the nozzle tip has a generally parabolic shape. Further, the intersection of the sidewalls and the axial channel defines a convex opening into the axial channel.

The spray pattern defined by the fluid spray from the spray nozzle has an elongated shape wherein the width of the spray pattern is substantially the width of the suction nozzle opening.

Further according to the invention, a method of making a cleaning tool comprises the steps of forming an elongated suction conduit adapted to be connected at one end to a source of suction, forming on another end of the elongated suction conduit a suction head having an elongated suction nozzle with an elongated opening therein and forming on the suction conduit a fluid conduit having an axial channel with a longitudinal axis adapted to be connected at one end to source of cleaning fluid to supply cleaning fluid to the fluid conduit. The method further comprises the step of forming on another end of the fluid conduit a nozzle tip with a nozzle opening extending therethrough to the axial conduit. The opening is generally rectangular in configuration through the nozzle tip. The opening is defined by sidewalls which slope outwardly from the axial channel at an acute angle to the longitudinal axis of the axial channel and with end walls which slope outwardly from the axial channel at an acute angle to the longitudinal axis. The length of the sidewalls and the acute angle of the end walls are selected so that the spray pattern defined by the fluid sprayed by the spray nozzle has an elongated shape wherein the width of the spray pattern is substantially the width of the suction nozzle opening at a distance from the nozzle tip to a point closely adjacent to the suction nozzle opening.

BRIEF DESCRIPTION OF THE DRAWINGS

The invention will now be described with reference to the drawings wherein.

DESCRIPTION OF THE PREFERRED EMBODIMENT

Figure 1:
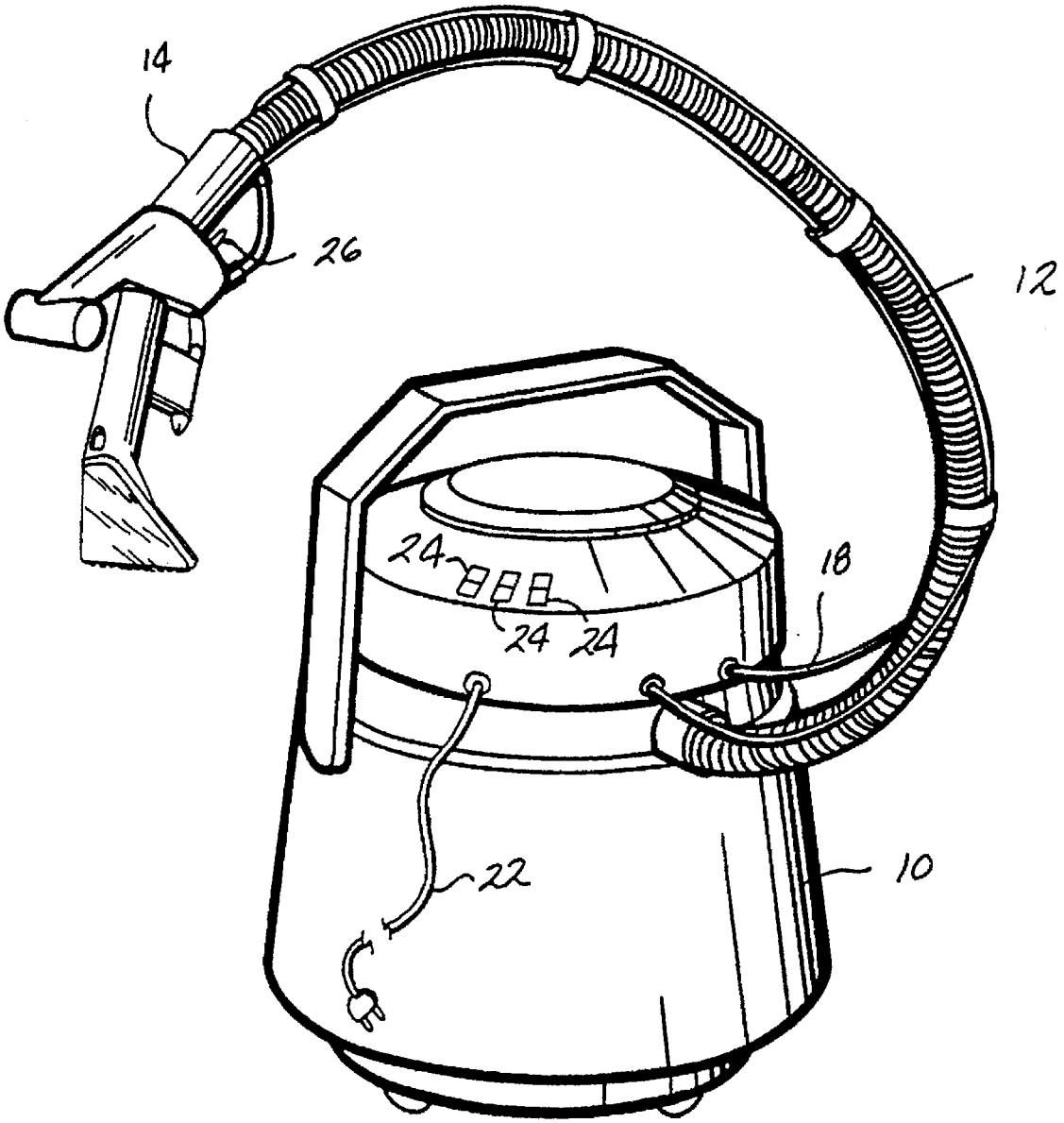
FIG. 1 is a perspective view of a water extraction machine and nozzle according to the invention.

Referring to the drawings and to FIG. 1 in particular, there is shown a water extractor 10 that internally mounts a vacuum motor (not shown), a fluid reservoir (not shown) for storing water or cleaning fluid and a fluid pump (not shown) for pumping the fluid from the reservoir. A suitable water extractor is disclosed in U.S. Pat. Nos. 5,287,587 and 5,287,590, which are incorporated herein by reference. A hose 12 has one end connected to the water extractor 10 in such a manner so that it is in fluid connection with the vacuum pump. The other end of the hose 12 mounts a tubular handle 14 which defines a suction conduit and which is adapted to releasably mount a suction head 16. A fluid line 18 extends from the water extractor 10 along the hose 12 and to the tubular handle 14. The fluid line 18 is fluidly connected to the fluid reservoir and pump within the water extractor 10. The extractor 10 has an electrical cord 22 to supply power to the pump and vacuum motor. Switches 24 control the operation of the vacuum motor and pump. A trigger 26 is mounted on the tubular handle to control the flow of liquid to the suction head.

The suction head 16 flairs outwardly to a suction tip 28 from the tubular handle 14. An elongated suction nozzle opening 30 is provided in the head 16 at the suction tip 28. Material, such as dirt and fluid, is drawn through the suction nozzle opening 30 during the operation of the water extractor 10. The head 16 generally extends downwardly from the tubular handle 14 at an acute angle with respect to the axis of the tubular portion so that a user grasping the tubular handle 14 can hold it at a comfortable angle while maintaining the suction tip in contact with the surface being cleaned.

Figure 3:
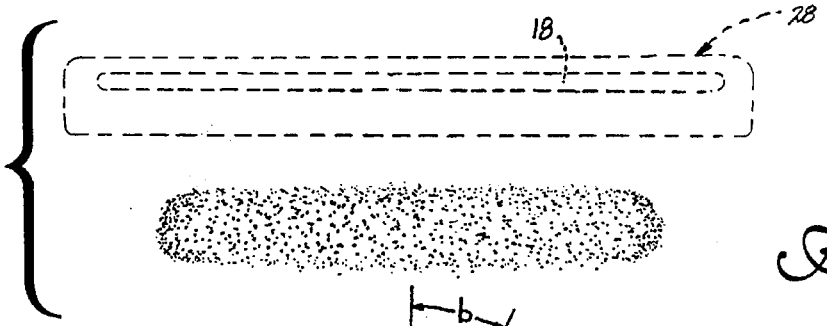
FIG. 3 is a schematic of the spray pattern produced by a nozzle according to the invention and illustrating the relative position of the suction nozzle.

A fluid conduit 36 is mounted to the tubular handle 14 through a pair of support arms 34. The fluid conduit 36 has an axial channel 52 therethrough with a longitudinal axis 54. A nozzle tip 38 forms an end on the fluid conduit 36 and has a nozzle opening 40 adapted to spray fluid from the reservoir onto the surface to be cleaned. Preferably, the suction head 16 and the fluid conduit 36 are integrally molded of a suitable thermoplastic. The nozzle opening 40 is designed to produce a spray pattern which has a width equal to the width of the suction nozzle opening 30 on the suction head 16 and a thickness which is relatively thin. The spray pattern generally has a rectangular configuration although it bows outwardly slightly at the sides as shown in FIG. 3. The spray pattern is desirably produced at the work surface directly adjacent the suction nozzle opening 30 of the suction head 16.

Figure 2:
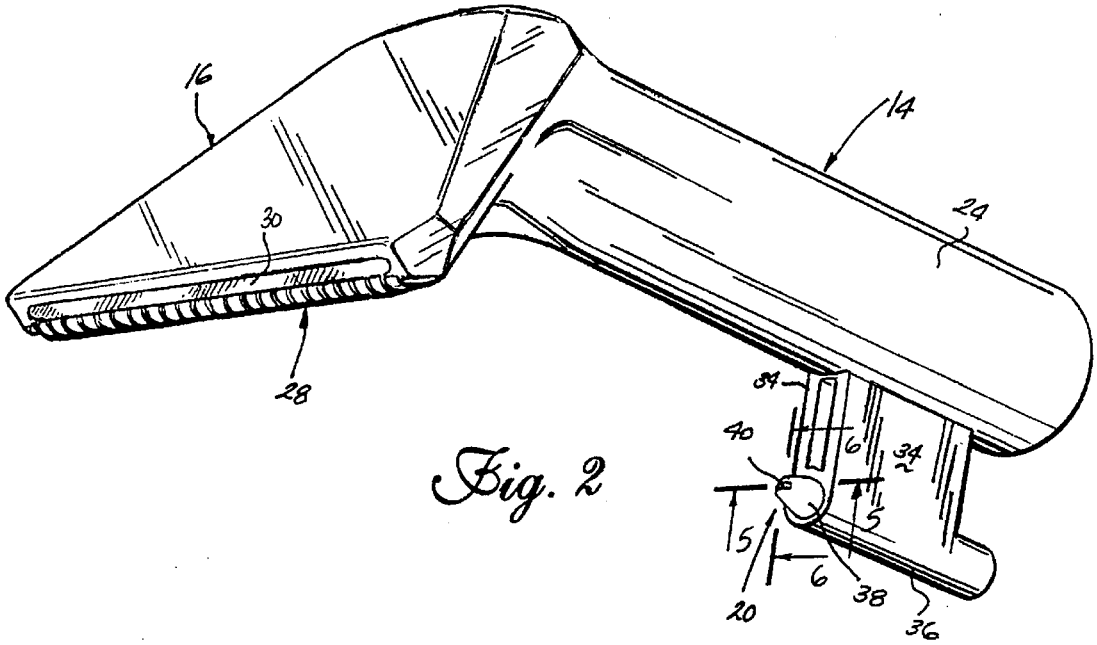
FIG. 2 is a perspective view of the suction head of the water extraction machine of FIG. 1 with the improved nozzle.
Figure 4:
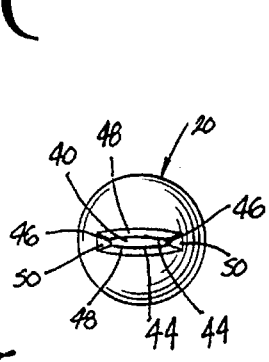
FIG. 4 is a from view of the nozzle of FIG. 2.

Referring to FIGS. 2 and 4, the nozzle tip 38 has an outer surface with a generally parabolic shape interrupted at the apex by the rectangular nozzle opening 40. The nozzle opening 40 is defined by opposing sidewalls 48 and end walls 50. The intersection of the sidewalls 48 and the axial channel 52 form edges 44 which are curved concave outwardly. The intersection of the end walls 50 and the axial channel 52 form edges 46 which are relatively linear.

Figure 5:
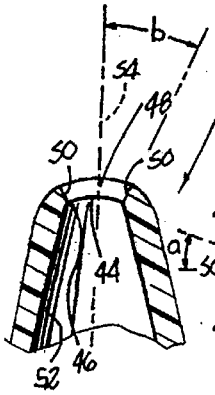
FIG. 5 is a sectional view taken along line 5—5 of FIG. 4.
Figure 6:
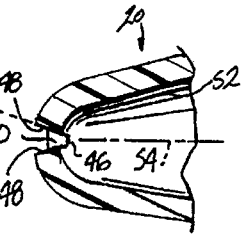
FIG. 6 is a sectional view taken along line 6—6 of FIG. 4.

Referring to FIGS. 5 and 6, the fluid conduit 36 has an axial channel 52 that intersects the nozzle opening 40. The axial channel 52 has a generally constant diameter, except that it tapers as it nears the nozzle opening 40. The fluid flows from the fluid line 18 through the axial channel 52. The fluid diverges after passing through the nozzle opening 40 and is directed toward and below the elongated suction nozzle opening 30.

The divergent sidewalls 48 extend a greater distance than the end walls 50 and define an angle alpha ($\alpha$) with the longitudinal axis 54 of the axial channel 52. The angle alpha and the length of the sidewalls 48 control the thickness of the spray pattern. The diverging end walls 50 form an angle beta ($\beta$) with the longitudinal axis 54 of the axial channel 52. The angle beta and the length of the end walls 50 define the width of the spray pattern. Therefore, the boundaries of the spray pattern 42 are formed by the angle alpha and sidewalls 48 and the angle beta and the end walls 50. The distribution of spray across the spray pattern is controlled by the angles of the sidewalls 48, end walls 50 and the pressure of the fluid.

The angles alpha and beta can vary over a relatively wide range, depending on the distance of the nozzle opening to the work surface, the width of the suction nozzle opening 30 and the pressure of the liquid passing through the nozzle opening 40. Typically, the angle alpha will be in the range of 5° to 37°, preferably 12° to 18°. The angle beta typically varies between 5° and 25°, preferably 12° to 18°. The pressure of the liquid will generally be in excess of 5 psig. In a specific example, in a pump having a pressure of 13 psi produced a flow rate of about 875 ml/min. in a nozzle tip with a spray pattern of 6 in.×0.75 in. (152 mm×19 mm). The sidewalls of the nozzle had an angle alpha of 15°, and the end walls of the nozzle had an angle beta of 15°. With this construction, the spray pattern produced at the work surface had a generally rectangular configuration of 3 in. by 0.5 in. at a distance of 4.25 in. from the nozzle in a cleaning tool having a suction nozzle width of 4.625 in.

In operation, the tubular handle 14 in connected to the hose 12 so that a vacuum or suction force created by the vacuum pump in the water extractor will draw fluid through the elongated suction nozzle opening 30 through the suction head and the hose 12 into the water extractor 10. In a similar manner, the fluid conduit 36 is fluidly connected to the fluid line 18 so that fluid pumped from the fluid reservoir within the water extractor 10 is directed through the fluid line 18 and sprays from the fluid nozzle 20 through the nozzle tip 38 to contact a carpet or upholstery surface slightly behind the suction tip 28.

When the water extraction machine is turned on, the vacuum pump and the fluid pump are energized. Fluid is pumped through the fluid line 18 and through the nozzle tip 38, which sprays the fluid in an evenly distributed pattern onto the surface to be cleaned. As the operator moves the suction head, the fluid is sprayed onto the carpet or fabric surface ahead of the suction nozzle opening so that the spraying and vacuuming go on simultaneously.

The spray pattern of fluid sprayed through the nozzle 32 is very important to ensure that the minimum mount of fluid is used. If too much fluid is used, the carpet or fabric may become too soaked for the water extractor 10 to remove substantially all the water, requiring longer drying times or otherwise damaging the work. Also, if a cleaning fluid is used instead of water, the excess fluid will increase the cost of cleaning the carpet. Preferably, an ideal spray pattern would be approximately the same width as the elongated opening 30 and be evenly distributed across the width of the spray pattern as illustrated in FIG. 3. The fluid nozzle 20 yields a spray pattern that limits the coverage area of the spray pattern while evenly distributing the fluid to minimize the fluid needed to clean the surface.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A cleaning tool for a deep cleaning vacuum machine comprising:

an elongated suction conduit adapted to be connected at one end to a source of suction;

a suction head connected to another end of the elongated conduit and having an open end forming an elongated suction nozzle with an elongated opening therein;

a fluid conduit having an axial channel with a longitudinal axis mounted on the elongated suction conduit and adapted to be connected at one end to a source of cleaning fluid to supply cleaning fluid to a surface to be cleaned;

the fluid conduit at another end forming a nozzle tip with a nozzle opening extending therethrough to the fluid conduit;

the nozzle opening being generally rectangular in configuration and being defined by sidewalls and end walls, the sidewalls sloping outwardly from the axial channel at an acute angle to the longitudinal axis of the axial channel and the end walls sloping outwardly from the axial channel at an acute angle to the longitudinal axis of the axial channel.

2. A cleaning tool according to claim 1 wherein the nozzle tip has a generally parabolic shape.

3. A cleaning tool according to claim 2 wherein the acute angle of the sidewall is in the range of 5° to 25°.

4. A cleaning tool according to claim 3 wherein the acute angle of the end walls is in the range of 5° to 37°.

5. A cleaning tool according to claim 4 wherein the intersection of the sidewalls and the axial channel defines a convex opening.

6. A cleaning tool according to claim 5 wherein the sidewalls have a slight convex shape.

7. A cleaning tool according to claim 1 wherein the acute angle of the sidewalls is in the range of about 12° to 18°.

8. A cleaning tool according to claim 1 wherein the acute angle of the end walls is in the range of about 12° to 18°.

9. A cleaning tool according to claim 1 wherein the intersection of the sidewalls and the axial channel defines a convex opening.

10. A cleaning tool according to claim 1 wherein the sidewalls have a slight convex shape.

11. A cleaning tool according to claim 1 wherein a spray pattern defined by fluid spray from the spray nozzle has an elongated shape wherein the width of the spray pattern is substantially the width of the suction nozzle opening.

12. A method of making a cleaning tool comprising the steps of:

providing an elongated suction conduit adapted to be connected at one end to a source of suction;

providing on another end of the elongated suction conduit a suction head having an elongated suction nozzle with an elongated opening therein;

providing on the suction conduit a fluid conduit having an axial channel with a longitudinal axis and adapted to be connected at one end to a source of cleaning fluid to supply cleaning fluid to a surface to be cleaned;

forming on the other end of the fluid conduit a nozzle tip with a nozzle opening extending therethrough to the fluid conduit, the opening being generally rectangular in configuration through the nozzle tip and defined by opposite sidewalls and opposite end walls;

forming the sidewalls of the nozzle opening with an outward slope from the axial channel at an acute angle to the longitudinal axis of the axial channel and forming the end walls with an outward slope from the axial channel at an acute angle to the longitudinal axis; and selecting the length of the sidewalls and the acute angle of the end walls so that the spray pattern defined by fluid sprayed from the spray nozzle has an elongated shape wherein the width of the spray pattern is substantially the width of the suction nozzle opening at a distance from the nozzle tip closely adjacent to the suction nozzle opening.

* * * * *